United States Patent [19]

Hirota et al.

[11] Patent Number: 4,705,265

[45] Date of Patent: Nov. 10, 1987

[54] AUTOMATIC SHEET FEEDING APPARATUS

[75] Inventors: Fumiyuki Hirota, Tachikawa; Tadashi Miwa, Hino; Yasushi Yamada, Tokyo, all of Japan

[73] Assignee: Konishiroku Photo Industry Co., Ltd., Tokyo, Japan

[21] Appl. No.: 835,473

[22] Filed: Mar. 3, 1986

[30] Foreign Application Priority Data

Mar. 11, 1985 [JP] Japan ..... 60-48925
Mar. 11, 1985 [JP] Japan ..... 60-48930

[51] Int. Cl.[4] ..... B65H 3/50
[52] U.S. Cl. ..... 271/122; 271/125
[58] Field of Search ..... 271/121, 122, 124, 125

[56] References Cited

U.S. PATENT DOCUMENTS 3,944,211 3/1976 Rasmussen ..... 271/122 X
4,418,904 12/1983 Fujimoto ..... 271/124 X

OTHER PUBLICATIONS

IBM Technical Disclosure Bulletin, vol. 23, No. 9, pp. 3957, 3958, Feb. 1981, "Second Sheet Restraint", R. A. Bielling et al.

*Primary Examiner*—Richard A. Schacher
*Attorney, Agent, or Firm*—Jordan B. Bierman

[57] ABSTRACT

An automatic sheet feeding apparatus for feeding sheets on a stacker one by one, includes a separation device having a sheet convey member for conveying a separated sheet and a double feed prevention member which is brought into tight contact with or separated from the convey member, and a sheet stop member for preventing movement of nonseparated sheets along a convey direction. When the separation device is in tight contact with the sheet during a separation operation, the sheet stop member is located in a first position where the sheet stop member does not prevent the separation operation. When the separation device is released and the sheet is conveyed, the sheet stop member is moved to a second position where the sheet stop member abuts against leading ends of sheets except for a sheet to be fed, thereby preventing movement of the sheets except for the sheet to be fed.

6 Claims, 16 Drawing Figures

AUTOMATIC SHEET FEEDING APPARATUS

BACKGROUND OF THE INVENTION

The present invention relates to an automatic sheet feeding apparatus, and more particularly, to an apparatus for stopping sheets at a predetermined position in a horizontal state and processing them, wherein the sheets are conveyed to the predetermined position, stopped there, and each sheet is processed and then returned to the predetermined position.

In order to copy a plurality of sets of an identical document consisting of a plurality of copies or originals (to be referred to as sheets hereinafter) in a conventional apparatus, a first sheet (actually the last page) is placed on a document table and is copied to produce a predetermined number of copies in a multicopying mode, a second sheet is then replaced with the first sheet and is copied similarly, and the third and subsequent sheets are sequentially placed on the document table to obtain a predetermined number of copies each. A stack of copies of the first sheet are stacked in the respective bins or the like, and then a stack of copies of the second sheet are overlayed on the respective first copies. The third or subsequent copies are respectively stacked on the immediately preceding ordered copies, thus obtaining a predetermined number of sets of an identical document. However, such copying and sorting is complicated and cumbersome.

In order to solve this problem, sorters are commercially available as conventional apparatuses for automatically sorting a plurality of sets of copies. However, when 20, 30 or more sets of copies must be sorted, a large space is inevitably required. Furthermore, removal of the sets of copies from the bins or the like is also time-consuming and cumbersome.

Recently, other conventional sorting apparatuses are proposed. In such apparatuses, a stack of sheets constituting a document are set on a stacker. A lowermost sheet of the stack is fed to a document table and is returned to the uppermost position of the stack after the copy operation. A currently lowermost sheet (the second lower sheet in the initial state) is fed to the document table and is returned onto the uppermost position after the copy operation. Every sheet is fed, copied and returned to the uppermost position in the same manner as described above, so that a single set of document copies is obtained. Subsequently, the above operation is repeated to obtain a predetermined number of sets of document copies. These apparatuses are described in Japanese Examined Patent Publication No. 50-34416, Japanese Unexamined Utility Model Publication No. 51-55445 and its entire specification, and Japanese Examined Patent Publication Nos. 55-27343 and 56-37536.

In reference to these apparatuses, strong demand has arisen for various types of apparatus for properly separating each sheet from the stacked sheets and feeding out the separated sheet.

For example, FIG. 1A shows a mechanism for feeding each sheet S from the lowermost position. A separation member 2 is urged against a feed roller 1, and the sheets fed by a convey roller 3 to the separation section are fed one by one.

In another conventional mechanism in FIG. 1B, a reverse rotation roller 4 is used in place of the separation member 2 in FIG. 1A.

In still another conventional mechanism in FIG. 1C, a reverse rotation belt 5 is used in place of the reverse rotation roller 4 in FIG. 1B.

In still another conventional mechanism in FIG. 1D, a reverse rotation roller 6 is disposed between two feed rollers 1A and 1B. A radial overlap distance d between the reverse rotation roller 6 and the feed rollers 1A and 1B is given to separate the sheets from each other utilizing rigidity of the sheets S.

In any of these examples, friction coefficients of the respective members satisfy the following condition:

$$\mu_A > \mu_B > \mu_C$$

where $\mu_A$: the friction coefficient between the feed roller 1 and the sheet S $\mu_B$: the friction coefficient between the sheet S and the separation members 2, 4, 5 and 6

$\mu_C$: the friction coefficient between the opposing surfaces of two adjacent sheets The sheets of the document are separated once in an SDF (Single Document Feeder) and an ADF (Automatic Document Feeder). However, the sheets of the document are repeatedly separated in an RDF (Recirculating Document Feeder), thus presenting the following problems.

(1) A separation member causes an identical sheet to wear since the separation member is always in tight contact with the sheet. In particular, when the content of the sheet S is written with a pencil and fed in the direction shown by an arrow in FIG. 2A, it smears or blurs since the separation member is always in slidable contact with the surface of the sheet. In the worst case, the content written with a pencil is partially erased.

(2) One of the separation members is held in the stationary state or continuously operated during the separation operation. The leading end of the sheet abuts against the separation member held in the stationary state when the sheet enters into the separation section, or the sheet receives a reaction force along a direction opposite to the convey direction. As shown in FIG. 2B, folds, turn-ups and wrinkles are then formed at the leading end of the sheet. In the worst case, the leading end of the sheet is torn.

SUMMARY OF THE INVENTION

It is an object of the present invention to provide an automatic sheet feeding apparatus wherein the conventional drawbacks can be eliminated, and sheets such as originals and copying sheets can be properly separated one by one without causing wear of the surface of a sheet, and without causing folding of and damage to a leading end of the sheet.

It is another object of the present invention to achieve the above operation with a compact structure.

In order to achieve the above and other objects of the present invention, there is provided an automatic sheet feeding apparatus for feeding sheets on a stacker one by one from a lowermost sheet, comprising a sheet stop member and a separation device having a sheet convey belt and a double feed prevention roller which is brought into tight contact with or separated from the convey belt, wherein when the separation device is in tight contact with the sheet during a separation operation, the sheet stop member is located in a first position where the sheet stop member does not prevent the separation operation; and when the separation device is released and the sheet is conveyed, the sheet stop member is moved to a second position where the sheet stop member abuts against leading ends of sheets except for a sheet to be fed, thereby preventing movement of the sheets except for the sheet to be fed.

DETAILED DESCRIPTION OF THE PREFERRED EMBODIMENTS

The present invention will be described in detail with reference to preferred embodiments in conjunction with the accompanying drawings.

Figure 1A:
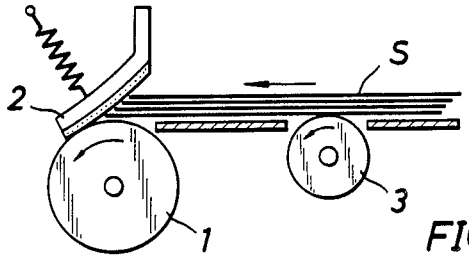
FIG. 1A PRIOR ART
FIGS. 1A to 1D are schematic sectional views for explaining various conventional separation apparatuses, respectively.
Figure 1B:
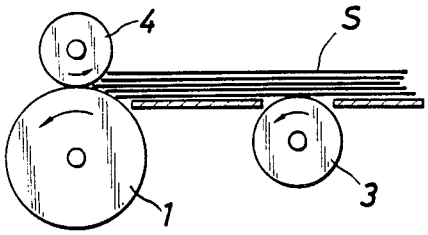
FIG. 1B PRIOR ART
Figure 1C:
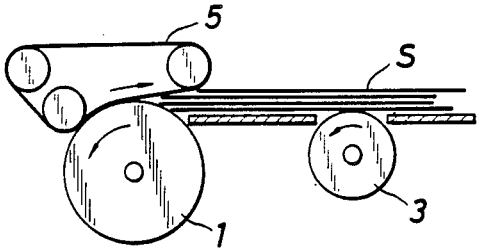
FIG. 1C PRIOR ART
Figure 1D:
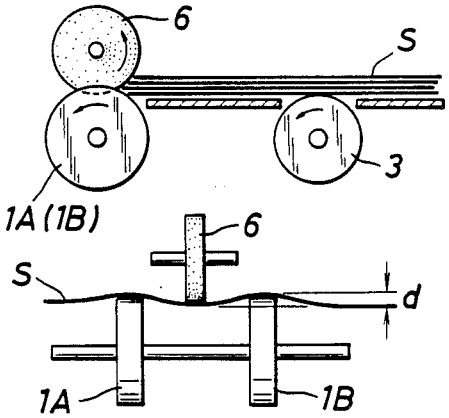
FIG. 1D PRIOR ART
Figure 2A:
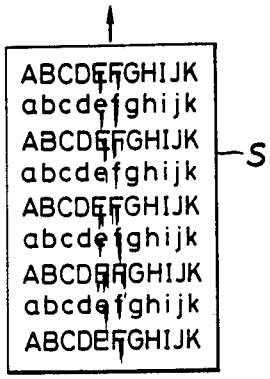
FIGS. 2A and 2B are front views showing damages of sheets fed by the conventional separation apparatus.
Figure 2B:
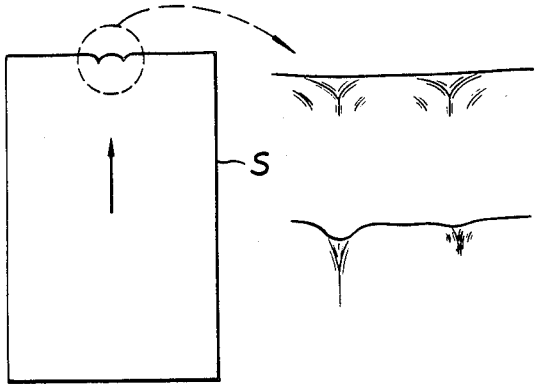
Figure 3:
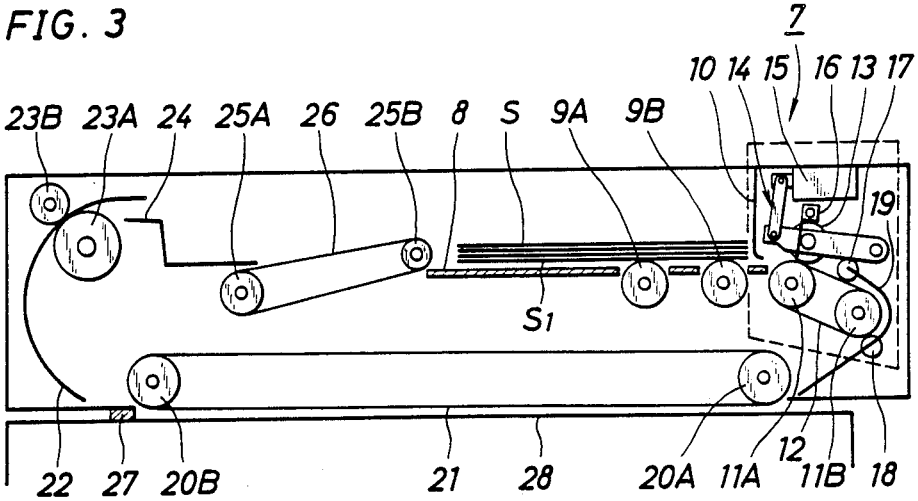
FIG. 3 is a sectional view of an automatic document handling system adapting an automatic sheet feeding apparatus according to an embodiment of the present invention.

FIG. 3 shows an automatic document handling system adapting an automatic sheet feeding apparatus according to the present invention. The automatic document handling apparatus includes a set table 8 for stacking a plurality of sheets S. First sheet feed rollers 9A and 9B are arranged in the right portion of the set table 8 in FIG. 3. An abutment plate 10 is located in the right of the set table 8.

Figure 4:
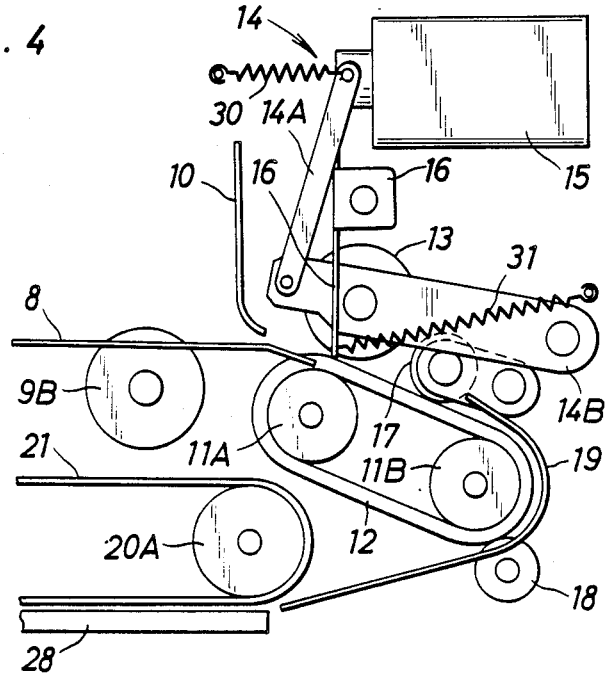
FIG. 4 is a partial enlarged view of a separation device in the automatic sheet feeding apparatus in FIG. 3.

Reference numeral 7 denotes a separation device. An enlarged view of the separation device 7 is shown in FIG. 4. The separation device 7 includes a separation belt 12 looped between rollers 11A and 11B, a separation roller 13 brought into contact with the separation belt 12 from its upper side, links 14A and 14B for bringing the separation roller 13 into contact with or separating it from the separation belt 12, a solenoid 15 for driving a link mechanism 14 constituted by the links 14A and 14B, a sheet stop member 16, second sheet feed rollers 17 and 18, and a guide plate 19. A conveyor belt 21 is arranged in front of the guide plate 19. The conveyor belt 21 is located on a document table 28 of a copying machine and looped between rollers 20A and 20B. A stop member 27 is at the left end (FIG. 3) in a predetermined position of the document table 28. An exhaust guide 22 and exhaust rollers 23A and 23B are arranged vertically from the left side of FIG. 3 to the upper side thereof. A sheet reception plate 24 is fixed to one end of the exhaust guide 22. A sheet aligning belt 26 is located to the right of the sheet reception plate 24. The sheet aligning belt 26 can be driven by rollers 25A and 25B.

The plurality of sheets S are stacked on the set table 8 located between the terminal end of the sheet aligning belt 26 and the abutment plate 10. The plurality of sheets S are conveyed by the first sheet feed rollers 9A and 9B and abut against the abutment plate 10. Some lower sheets S are then moved to the separation device 7 through a space formed below the abutment plate 10. These lower sheets S are further separated by the separation device 7 one by one, so that only a lowermost sheet $S_1$ is conveyed along the separation belt 12 and reaches the second feed rollers 17 and 18. The lowermost sheet $S_1$ is guided by the guide plate 19 and reaches the conveyor belt 21. Thereafter, the lowermost sheet $S_1$ is conveyed by the conveyor belt 21 on the document table 28 until the leading end of the sheet reaches the stop member 27. In this state, single copying is made. The stop member 27 is then removed and the sheet $S_1$ is conveyed by the conveyor belt 21 to reach the exhaust guide 22 and the exhaust rollers 23A and 23B. The sheet $S_1$ is conveyed by the exhaust rollers 23A and 23B and reaches the sheet aligning belt 26. The sheet $S_1$ is returned by the sheet aligning belt 26 to the uppermost position of the sheets S. The second lowermost sheet $S_2$ is separated from the remaining lower sheets and fed and conveyed. The sheet $S_2$ is then subjected to single copying while it is stopped by the stop member 27 at the predetermined position. Thereafter, the stop member 27 is removed, and the sheet $S_2$ is conveyed and exhausted. Finally, the sheet $S_2$ is returned to the uppermost position of the stacked sheets S. In the same manner as described above, all the sheets S are fed, conveyed, stopped, subjected to single copying, exhausted and returned to the current uppermost positions, so that one set of copies of the sheet S is made. The above cycle is repeated by a predetermined number of times to obtain the corresponding number of sets of copies.

The operation of the separation device 7 will be described with reference to FIGS. 5A and 5B.

Figure 5A:
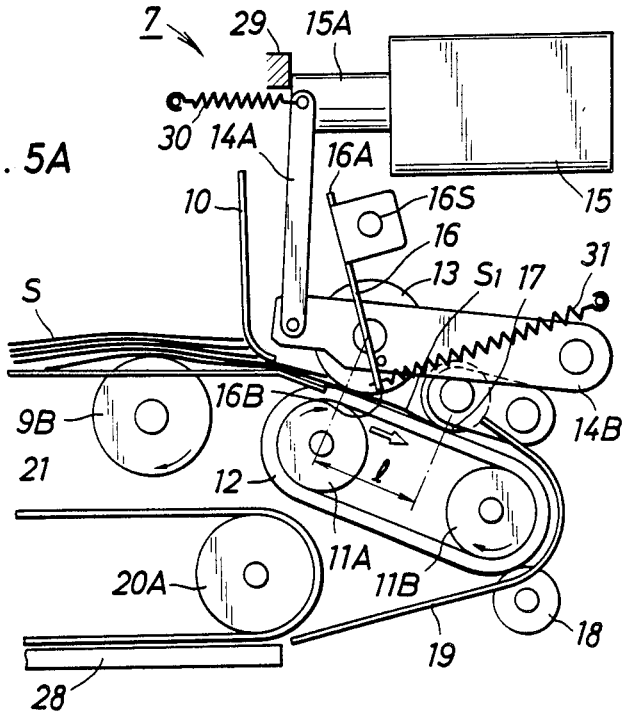
FIGS. 5A and 5B are sectional views for explaining the operation of the separation device in FIG. 4.
Figure 5B:
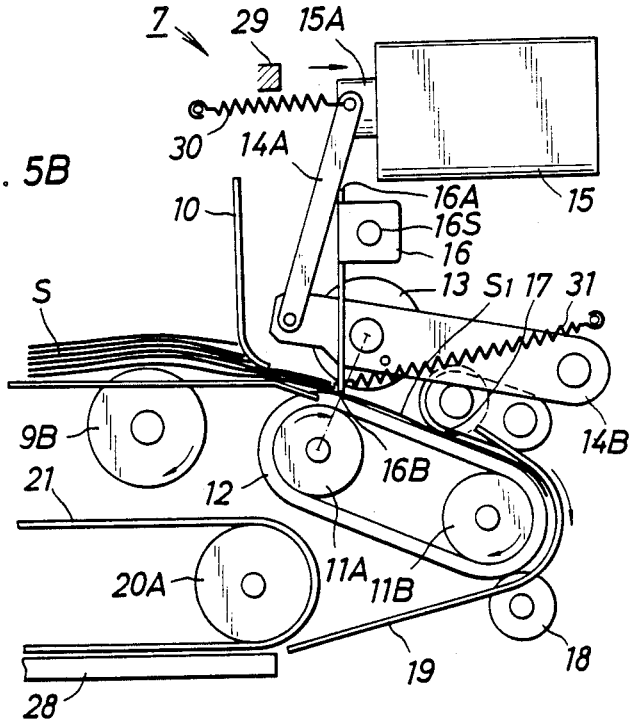

FIGS. 5A and 5B show the operation wherein only the lowermost sheet $S_1$ is separated from the stack of sheet S.

As shown in FIG. 5A, a stack of sheets is conveyed by the first sheet feed rollers 9A and 9B along a direction toward the separation device 7 and is abutted against the abutment plate 10. Some lower sheets are further fed through a space below the abutment plate 10. In this case, since a plunger 15a of the solenoid 15 is held in the elongated state, the separation roller 13 is held in tight contact with the separation belt 12 through the links 14A and 14B. The separation roller 13 is not rotated since it is fixed by the link 14B, while the separation belt 12 is rotated in the direction of arrow in FIG. 5A while the separation belt 12 is held in tight contact with the separation roller 13. Some lower sheets pass under the abutment plate 10 and reach the separation roller 13. Only the lowermost sheet $S_1$ is separated by the separation roller 13 due to the specific friction coefficient as previously described. The lowermost sheet $S_1$ is conveyed by the separation belt 12 to the second sheet feed roller 17. In this case, the sheet stop member 16 is located in the first position where the member 16 does not interfere conveying of the sheet.

When the leading end of the sheet $S_1$ reaches a position where the sheet $S_1$ can be clamped between the second sheet feed roller 17 and the separation belt 12 (the position is detected by a sensor (not shown), the separation belt 12 is temporarily stopped, as shown in FIG. 5B. The solenoid 15 pulls the links 14A and 14B, and then the separation roller 13 is moved upward by about 3 mm. The separation roller 13 is separated from the separation belt 12. At the same time, a distal end 16A of the sheet stop member 16 is urged to the side surface of the swinging link 14A and is rotated clockwise. The sheet stop member 16 thus reaches the second position. In the second position, a lower end face 16B of the sheet stop member 16 is located at a position aligned with an extended line of a circumscribed line of contact between the separation belt 12 and the separation roller 13 (FIG. 5A). The lower side surface of the sheet stop member 16 instead of the separation roller 13 holds the leading ends of the subsequent sheets except for the sheet $S_1$, thereby preventing the subsequent sheets from being fed. In this manner, the sheet stop member 16 prevents conveying of the subsequent sheets and at the same time is brought into contact with the sheet $S_1$. However, unlike in the conventional separation member, the sheet stop member 16 is not brought into tight contact with but in slight contact with the sheet $S_1$. Therefore, the sheet surface is not worn.

Figure 6:
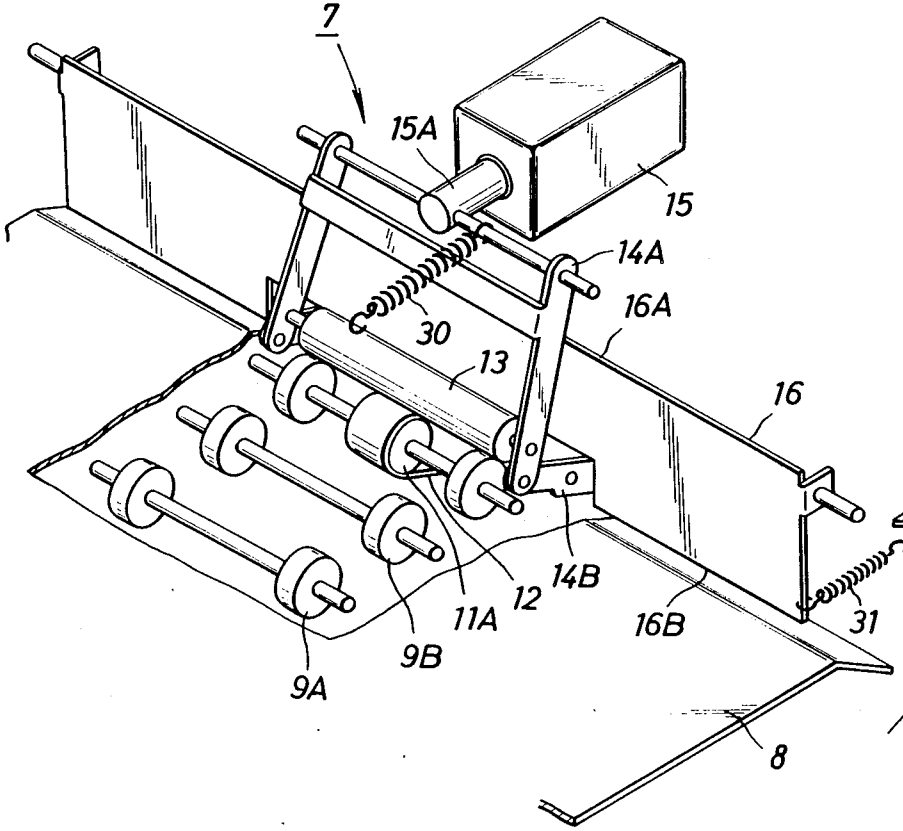
FIG. 6 is a partial perspective view of the separation device in FIG. 4.

As soon as the above operation of the separation belt 12 is completed, it restarts rotation. The sheet $S_1$ whose leading end is clamped by the second sheet feed roller 17 passes along another second sheet feed roller 18. The sheet $S_1$ is then conveyed to the conveyor belt 21 on the document table 28. A sensor (not shown) is arranged near the second sheet feed roller 18. When a predetermined period of time has elapsed after the trailing end of the sheet $S_1$ is detected, feeding operation of the next sheet is started. FIG. 6 is a perspective view showing the state of the separation device 7 in FIG. 5A when viewed in the direction of the abutment plate 10 (the abutment plate 10 is omitted).

The sheet stop member 16 according to the present invention need not be interlocked with separating/contacting operation of the separation device. However, in this embodiment, as shown in FIGS. 3 to 6, the sheet stop member 16 is synchronized with separating/contacting of the separation roller 13 driven by the solenoid 15.

Referring to FIG. 5A, the plunger 15A of the solenoid 15 is pulled and is biased by a spring 30. The biased plunger 15A abuts against and is stopped by a stopper 29 located at a fixed position. In this state, the separation roller 13 linked to the plunger 15A through the links 14A and 14B is located in the first position where the separation roller 13 is in tight contact with the separation belt 12. In this case, the sheet stop member 16 is set free since the upper end 16A is separated from the link 14A. The sheet stop member 16 is pulled by a spring 31 and swings about a shaft 16S. The lower end face 16B is moved from the contact position to a position where separation of the sheet S is not interfered.

Referring to FIG. 5B, the plunger 15A of the solenoid 15 is pulled to locate the separation roller 13 at the second position where the roller 13 is separated from the separation belt 12. In this case, the upper end 16A of the sheet stop member 16 is urged by the link 14A, so that the sheet stop member 16 is pivoted clockwise about the shaft 16S. The lower end face 16B of the sheet stop member 16 is moved to the vicinity of the position where the separation roller 13 is in tight contact with the separation belt 12.

By properly selecting the position of contact for the sheet stop member 16 with the link 14A, the lower end face 16B of the sheet stop member 16 is set at positions respectively suitable as the first and second positions.

In the above description, the solenoid is used as a driving source. However, a motor or the like may be used in place of the solenoid. The link mechanism can also be modified in accordance with the operation of the driving source. The operation of the sheet stop member 16 interlocked with the link mechanism is not limited to swinging, but can be replaced with vertical linear movement or a combination of swinging and vertical linear movement.

The separation roller 13 is a friction member such as urethane rubber or silicon rubber. The separation roller 13 preferably comprises a limiting power transmitting means (a so-called torque limiter) for transmitting a torque until a force acting on the roller surface reaches a predetermined value and for inhibiting transmission of the torque when the force exceeds the predetermined value.

Figure 7:
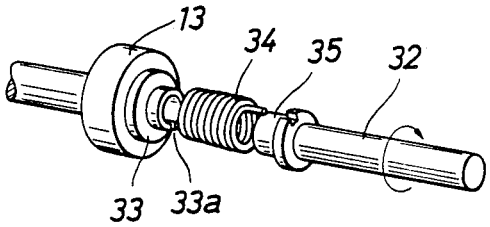
FIG. 7 is a perspective view of a torque limiter.

An arrangement of a torque limiter will be described with reference to FIG. 7. The separation roller 13 is mounted on a separation roller boss 33 rotatably mounted around a separation roller shaft 32. A spring joint 34 is mounted on the separation roller shaft 32 at one end face of the separation roller boss 33. One end of the spring joint 34 is securely held by a spring support member 35. The spring support member 35 is fixed to the separation roller shaft 32. The other end of the spring joint 34 is mounted around a cylindrical portion **33*a* extending at one end face of the separation roller boss 33. In other words, the cylindrical portion 33*a* is clamped by the inner surface of the other end of the spring joint 34. The axial torque of the separation roller shaft 32 is transmitted to the separation roller boss 32 having the separation roller 13 by means of a friction force between the inner surface of the spring joint 34 and the outer surface of the cylindrical portion 33*a***.

Figure 8A:
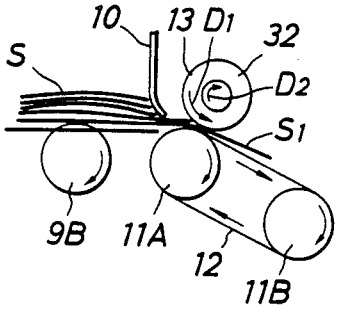
FIGS. 8A and 8B are schematic sectional views for explaining the operation of the torque limiter in FIG. 7.
Figure 8B:
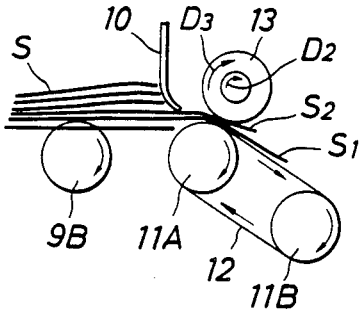

The operation of the torque limiter will be described with reference to FIGS. 8A and 8B.

When the torque limiter is used as the separation roller 13, a rotational torque along one direction $D_2$ is normally applied on the shaft 32. FIG. 8A shows proper separation operation. Only the sheet $S_1$ is clamped between the separation roller 13 and the separation belt 12. In this case, the friction coefficients of the respective members satisfy the following conditions:

$$\mu_A > \mu_C,\ \mu_B > \mu_C$$

where $\mu_A$: the friction coefficient between the separation belt 12 and the sheet S $\mu_B$: the friction coefficient between the separation roller 13 and the sheet S $\mu_C$: the friction coefficient between the two sheets The limit value of the torque limiter is set to be less than the axial torque generated on the basis of a contact force of the separation roller 13 and the friction coefficient $\mu_B$. The separation roller 13 is disengaged from the shaft 32 and is rotated in a direction $D_1$ indicated by an arrow in FIG. 8A. However, as shown in FIG. 8B, when proper sheet separation is not performed and the two sheets $S_1$ and $S_2$ are inserted between the separation roller 13 and the separation belt 12, the friction coefficient $\mu_C$ of the adjacent sheets is smaller than the friction coefficients $\mu_B$ and $\mu_A$. Therefore, the torque of the shaft 32 is transmitted to the separation roller 13 and is rotated in a direction $D_3$. The sheet $S_2$ is returned in a direction opposite to the convey direction. Therefore, double feeding is prevented, and only the sheet $S_1$ is fed.

As described above, the tight contact of the separation roller 13 with the separation belt 12 is released. The separation roller 13 is brought into direct contact with only the leading end portion of the sheet. More particularly, a length l between the separation roller 13 and the second sheet feed roller 17, as shown in FIG. 5A, is normally limited to about 10 to 20 mm. Even if the content of the sheet is written with a pencil, the contact length is limited to about 10 to 20 mm. In practice, this space generally constitutes a blank portion. Therefore, substantially no practical problems occur.

Furthermore, when a torque limiter is used as the separation roller 13, system reliability is improved by returning the sheet S in the reverse direction. In addition, the separation roller 13 can be freely rotated independently of the shaft 32 and is driven along the rotational direction of the separation belt 12 when a single sheet is fed. Unlike in the case of a mechanism using a fixed separation member or a reverse rotation roller (or belt) to apply a reaction force along a direction opposite to the convey direction, the leading end of the sheet is not worn or damaged.

Figure 9A:
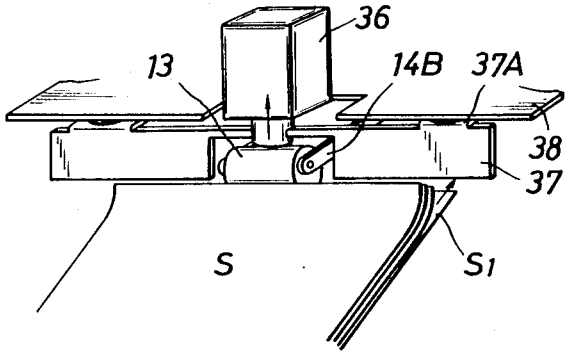
FIGS. 9A and 9B are perspective views of a separation device in an automatic sheet feeding apparatus according to another embodiment of the present invention.
Figure 9B:
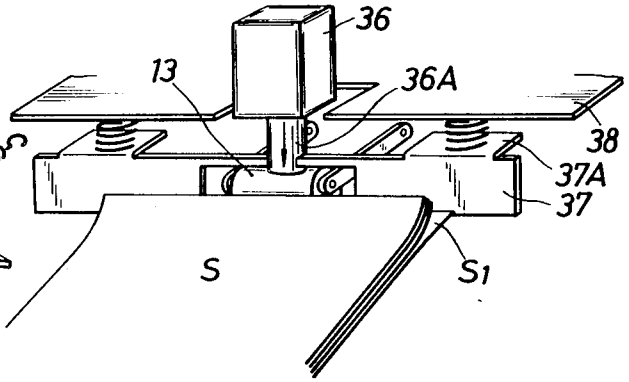

FIGS. 9A and 9B are perspective views of a separation device in an automatic sheet feeding apparatus according to another embodiment of the present invention.

The sheet stop member 16 in the previous embodiment stops the sheets except for one sheet or releases them upon pivotal movement about the rotating shaft. However, such operation can be performed by vertical movement using a solenoid 36 or the like.

FIG. 9A shows a release state wherein a sheet stop member 37 is moved upward to allow the sheet $S_1$ to pass thereunder. In this case, a bent portion 37A of the sheet stop member 37 abuts against an upper stationary plate 38 and is located at the upper stop position.

FIG. 9B shows a stop state wherein a plunger 36A of the solenoid 36 is held in an elongated state. The sheet stop member 37 is then moved downward and presses the outer surface of the separation belt 12. In this state, the sheets S are stopped by the sheet stop member 37.

In the above embodiments, the sheets are returned to the uppermost positions of the stack after copying is completed. However, after copying, the sheets can be stacked at a position different from the predetermined position. Furthermore, the present invention can also be applied to other apparatuses for performing operations other than copying.

According to the automatic sheet feeding apparatus as described above, the sheet stop member is located in the position where the sheet stop member does not interfere sheet convey operation while the separation device is in contact with the sheets so as to separate them. However, when the separation device performs sheet convey operation, the sheet stop member is moved to a position where the subsequent sheets are stopped. The reliability of the apparatus for feeding a sheet below the sheet stop member can be improved. Nonfeeding, double feeding, wear of the image surface of the sheet, damage to the leading end of the sheet can be prevented. A more variety of sheets can be fed and separated by the automatic sheet feeding apparatus of the present invention, than with the conventional automatic sheet feeding apparatus.

What is claimed is:

1. An automatic sheet feeding apparatus for feeding sheets on a stacker one by one, characterized by comprising a separation device having a sheet convey member for conveying a separated sheet and a double feed prevention member which is brought into tight contact with or separated from said convey member, and a sheet stop member for preventing movement of nonseparated sheets along a convey direction, wherein when said separation device is in tight contact with said sheet during a separation operation, said sheet stop member is located in a first position where said sheet stop member does not prevent the separation operation; and when said separation device is released and the sheet is conveyed, said sheet stop member is moved to a second position where said sheet stop member abuts against leading ends of sheets except for a sheet to be fed, thereby preventing movement of the sheets except for the sheet to be fed.

2. An apparatus according to claim 1, wherein said sheet stop member is rotated about a single rotating shaft, so that said sheet stop member is selectively located in the first or second position.

3. An apparatus according to claim 1, wherein said sheet stop member is selectively located in the first or second position upon vertical movement thereof.

4. An apparatus according to claim 1, wherein one of said sheet convey member and said double feed prevention member of said separation device comprises limiting power transmitting means for transmitting an axial torque until a force acting on said sheet convey member or said double feed prevention member reaches a predetermined value and for inhibiting transmission of the axial torque when a force acting thereon exceeds the predetermined value.

5. An apparatus according to claim 1, wherein said sheet stop member is operated interlocking with a drive mechanism for effecting contacting/separation movement of said separation device.

6. An apparatus according to claim 5, wherein said drive mechanism comprises a link mechanism driven by a solenoid.

* * * * *